US005603504A

United States Patent [19]

Powell

[11] Patent Number: 5,603,504

[45] Date of Patent: Feb. 18, 1997

[54] WORD GAME

[76] Inventor: Michael A. Powell, 1277 Norman Pl., Los Angeles, Calif. 90049

[21] Appl. No.: 605,846

[22] Filed: Feb. 26, 1996

[51] Int. Cl.[6] ..... A63F 9/00

[52] U.S. Cl. ..... 273/348.4; 273/272; 273/DIG. 30

[58] Field of Search ..... 273/344, 345, 273/346, 347, 272, DIG. 30; 434/112

[56] References Cited

U.S. PATENT DOCUMENTS 3,107,097 10/1963 Warden ..... 273/344

3,857,566 12/1974 Lemelson et al. ..... 273/346

4,004,811 1/1977 Brandin ..... 273/272

4,204,341 5/1980 Nowak ..... 434/112

*Primary Examiner*—William H. Grieb

*Attorney, Agent, or Firm*—Harlan P. Huebner

[57] ABSTRACT

A word game utilizing a game board containing the vowels and consonants of the English alphabet with each letter placed in a defined letter area. A plurality of markers that are thrown at the board of such a structure to releasably stick to the board. The object of the game being to make a recognized word in a time less than an opponent after a predetermining plurality of markers are thrown at the board and land in letter areas.

8 Claims, 2 Drawing Sheets

WORD GAME

BACKGROUND OF THE INVENTION

1. Field of the Invention

This invention relates to a word game that is played with a game board including the letters of the alphabet and markers that are thrown at the board that will adhere to the board with the object of making a word from the letters to which the markers adhere.

2. Description of the Prior Art

There are various word games that use tiles with letters that are played on a table and are shifted or added on to each other to make words. In these games a player is dealt the tiles and can select his plays.

However, the inventor is not aware of any word games that actually involve chance to engage letters in an attempt to make a word by throwing a marker at letters on a game board.

SUMMARY OF THE INVENTION

It is a purpose of the present invention to provide a game board, preferably made out of a cloth type material that is mounted on a wall and the board has an arrangement of letters of the English alphabet including all the vowels and consonants.

An object of the present invention is to provide a plurality of markers such as balls that contain a coating which will releasably stick to the game board when the markers are thrown at the board by a game player.

Another object of the present invention is to provide a game board wherein the vowels and consonants are each framed by lines that outline a area to be represented by a vowel or consonant when a marker sticks to the game board when it is thrown so that the person throwing receives the use of that letter in trying to form a word.

A still further object of the present invention is to provide a game where a number of markers or balls are available to each contestant to throw at the game board and upon completion of the throws to endeavor to make words that are recognizable as those found in the dictionary.

A yet further object of the present invention is to provide a game board wherein the areas for individual vowels is larger that for the areas for individual consonants.

Another object of the present invention is to provide a word game that can have different rules and time limitations to form words dependent upon the age or ages of the contestants playing the game.

These and other objects and advantages will become apparent from the following part of the specification wherein details have been described for the competence of disclosure, without intending to limit the scope of the invention which is setforth in the appended claims.

BRIEF DESCRIPTION OF THE DRAWINGS

These advantages may be more clearly understood from the following description and by reference to the drawings in which.

DETAILED DESCRIPTION OF THE PREFERRED EMBODIMENT

Figure 1:
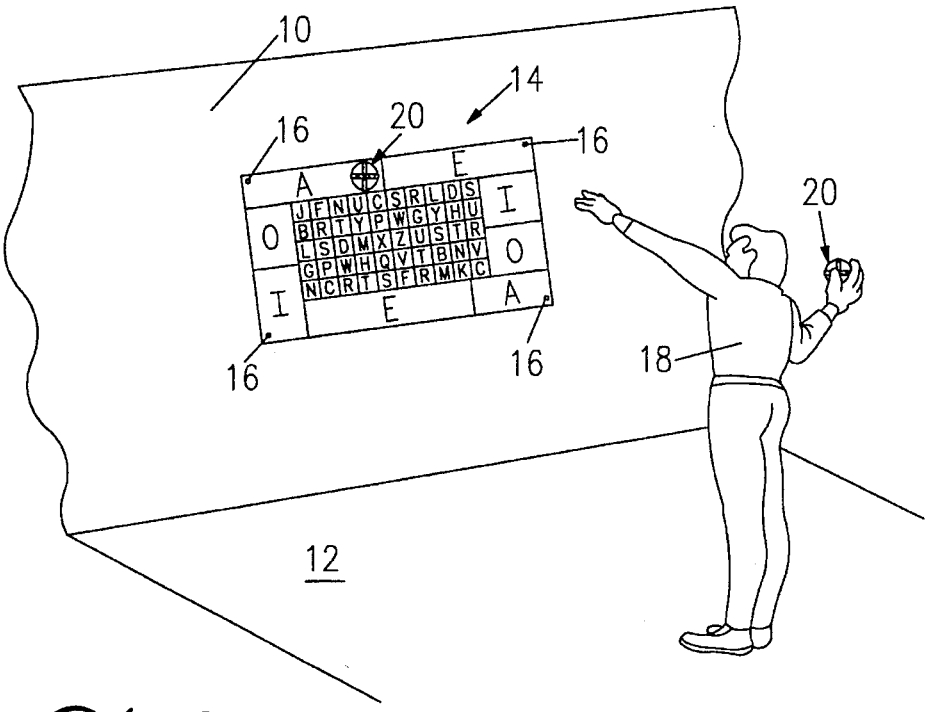
FIG. 1 is an environmental view of the word game invention as it would be played by a contestant.

Referring to FIG. 1 there is illustrated a partial wall 10 and floor 12 with a letter game board designated 14 mounted on the wall 10 by any suitable means, such as pins 16.

Figure 2:
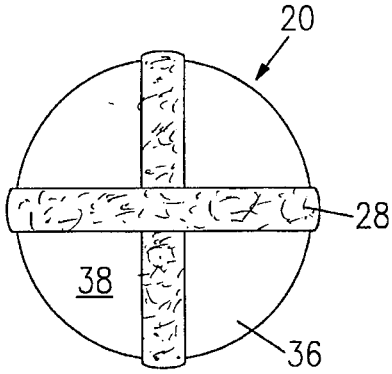
FIG. 2 is a view of the marker or ball used to play the word game which includes a surface of material to releasable hold the marker or ball to the game board and the areas where letters are placed when the ball is thrown.

In order to play the word game a player 18 standing on the floor 12 in front of the wall 10 and board 14 will throw individually a preselected number of light weight markers or balls designated 20, such as seen in better detail in FIG. 2.

The balls 20 when thrown due to construction to be discussed will releasably stick to the game board 20. After the predetermined number of balls 20 have been thrown there is preferably a time limit for the player or contestant 18 to make a word that is recognized in a dictionary.

Figure 3:
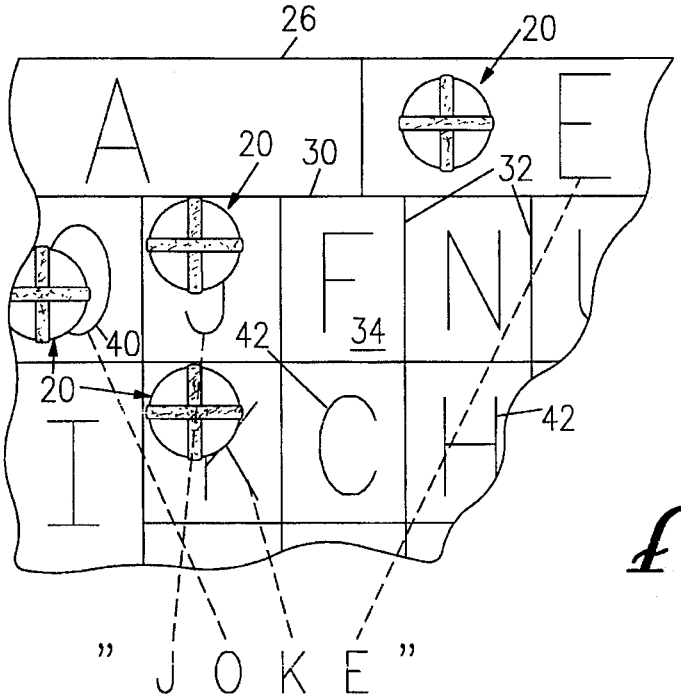
FIG. 3 is a fragmentary view of the game board of the present invention that is made of cloth or cloth type of material to which markers may stick showing a word being made from the letters.

In the case of FIG. 3 the player 18 has thrown four balls 20 with one sticking in a area, to be described enclosing an "O", an "E", a "J" and a "K". The player 18 can then think and create the word "JOKE".

After one player 18 has taken his or her turn the next player 18 will compete and try to make a word and secondly do it in quicker time than a preceding player or players 18.

Other rules may also be created for play such as two vowels must be engaged by the markers or balls 20 in order to make a word, also the number of balls 20 that each player 18 may use may vary. Further the distance from the game board 14 for a player 18 to stand may vary with age and/or size of the people playing. As can be seen a number of different rules may be utilized without departing from the spirit of the present invention.

Turning now to the structure, the game board 14 is preferably rectangular with left and right edges 22 and 24 respectively and top and bottom edges 26 and 28 respectively.

Figure 4:
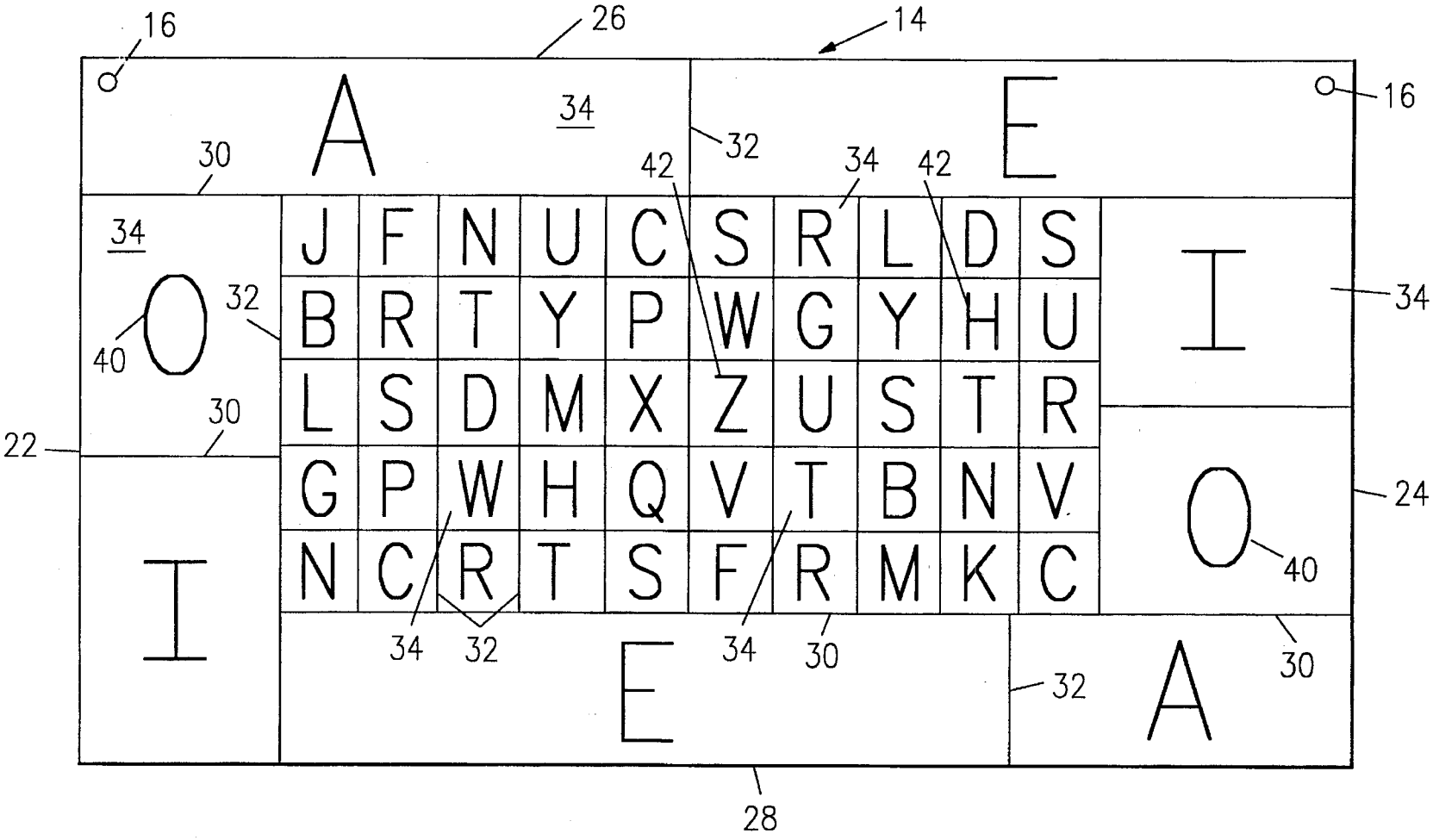
FIG. 4 is an elevational view of the entire game board in one configuration with the consonants in the center and in smaller lined letter areas that the vowels which are placed around the periphery.

As can be seen in FIG. 4 the interior of the game board 14 is divided by intersecting horizontal lines 30 and vertical lines 32 forming letter areas 34. As an illustration the vowel "O" 40 may be within a letter area 34 defined by left edge 22, top and bottom horizontal lines 30 and interior vertical line 32.

In the case of the preferred game board 14, the inventor places all the consonants 42 and the vowel "U" in the center of the game board in letter areas 34 that are relatively small. He places the other more commonly used vowels 40 in larger letter areas 34 around the perimeter of the board 14, see FIG. 4.

Now with regard to the material of the game board 14 it is preferred that the board be cloth with the indicia lines painted or silk screened thereon. In order for the marker or balls 20 to stick on the board a cloth or material a slightly roughened surface is preferred. Also with the board of a cloth material it may be folded up for storage and not take up much room.

The marker or ball 20 is preferably a PING PONG ball 36 which is relatively light weight and small so as to be easily thrown by people of all ages. The outer surface 38 of the ball 36 is preferably coated with a material such as VELCRO 38 that will adhere to the material of the game board when it hits the board. With VELCRO the ball 36 may easily be removed for reuse.

The VELCRO coating 38 may be strips as shown in FIG. 2 or as a full coating around the ball.

The invention and its attendant advantages will be understood from the foregoing description and it will be apparent that various changes may be made in the form, construction and arrangements of the parts without departing from the spirit and scope thereof or sacrificing its material advantages, the arrangements herein before described being merely by way of example. I do not wish to be restricted to the specific forms shown or uses mentioned, except as defined in the accompanying claims, wherein various portions have been separated for clarity of reading and not for emphasis.

I claim:

1. A word game to be played by any number of persons where the object is to make a recognized word in the least possible time, said game comprising:

a game board having marginal edges adapted to be vertically mounted on a wall, said board including letter areas with a consonant or vowel of a language positioned individually within each of said letter areas, said letter areas at least for some of said vowels being larger than said letter areas for consonants;

a plurality of markers adapted to be thrown by a person at said board from a predetermined distance and of a construction to releasably stick to said board, the prime purpose being to land at random in enough letter areas to spell a recognized word from the letters within the areas.

2. A word game as defined in claim 1 wherein:

said game board is formed of cloth material and said letter areas are define by vertical and horizontal lines.

3. A word game as define in claim 2 wherein:

said cloth material is felt.

4. A word game as defined in claim 2 wherein:

said marker is a hollow ball that is light weight and may be thrown against the board and will releasably stick thereto.

5. A word game as define in claim 4 wherein:

said hollow ball is coated with a material that will releasably adhere to said cloth material game board.

6. A word game as defined in claim 5 wherein:

said coating is VELCRO that will adhere to the cloth material.

7. A word game as defined in claim 1 wherein:

said letter areas for at least some of said vowels are arranged around said marginal edges of said board and the remaining smaller letter areas are arranged within said larger letter areas on said board.

8. A word game as defined in claim 7 wherein:

some of said letter areas for said vowels are larger than other letter areas for other vowels.

* * * * *